US006561438B1

(12) United States Patent
Restive et al.

(10) Patent No.: US 6,561,438 B1
(45) Date of Patent: May 13, 2003

(54) FOAM GENERATING NOZZLE ASSEMBLY

(75) Inventors: Mario J. Restive, Frankfort, NY (US); Aaron Guiliano, Rome, NY (US); George Mitchell, Utica, NY (US)

(73) Assignee: The Fountainhead Group, New York Mills, NY (US)

( * ) Notice: Subject to any disclaimer, the term of this patent is extended or adjusted under 35 U.S.C. 154(b) by 0 days.

(21) Appl. No.: 09/484,139

(22) Filed: Jan. 18, 2000

Related U.S. Application Data

(63) Continuation-in-part of application No. 09/114,766, filed on Jul. 14, 1998, now Pat. No. 6,015,100.

(60) Provisional application No. 60/052,585, filed on Jul. 15, 1997.

(51) Int. Cl.[7] ..... G03C 1/08; A62C 5/00; A62C 5/02; A62C 31/02; B05B 1/00

(52) U.S. Cl. ..... 239/428.5; 239/311; 239/600; 239/589; 239/310

(58) Field of Search ..... 239/428.5, 311, 239/600, 589, 310

(56) References Cited

U.S. PATENT DOCUMENTS 3,764,069 A 10/1973 Runstadler, Jr. et al.
3,836,076 A * 9/1974 Conrad et al. ..... 239/432
3,918,647 A 11/1975 Lamz et al.
4,098,851 A * 7/1978 Shulte et al. ..... 261/76
4,103,827 A 8/1978 Kumazawa
4,219,159 A 8/1980 Wesner
4,258,885 A * 3/1981 Legeza ..... 239/601
4,330,086 A * 5/1982 Nysted ..... 239/428.5
4,588,131 A 5/1986 Yamamoto et al.
4,619,402 A 10/1986 Yamamoto
4,742,642 A 5/1988 Yamamoto
5,054,688 A * 10/1991 Grindley ..... 239/428.5
5,058,809 A * 10/1991 Carroll et al. ..... 239/428.5
5,085,371 A * 2/1992 Paige ..... 239/428.5
5,427,181 A * 6/1995 Laskaris et al. ..... 169/14
6,015,100 A 1/2000 Restive
6,042,089 A * 3/2000 Klein ..... 261/76

* cited by examiner

*Primary Examiner*—Michael Mar
*Assistant Examiner*—Davis Hwu
(74) *Attorney, Agent, or Firm*—Brian B. Shaw, Esq.; Roger Aceto, Esq.; Harter, Secrest & Emery LLP

(57) ABSTRACT

A low pressure foaming nozzle assembly having a modular construction for permitting the ready interchange of nozzle tips. The foaming nozzle assembly may be constructed of two pieces, with a first configuration employing a flow body and an engaging nozzle tip and a second configuration employing a pair of mating halves, wherein each mating half includes a portion of a venturi, a throat and a nozzle tip. The assembly cooperatively engages a foaming liquid source such as a wand, and upon pressure on the foaming liquid source, a foam is generated.

7 Claims, 9 Drawing Sheets

FOAM GENERATING NOZZLE ASSEMBLY

RELATED APPLICATIONS

The present application is a continuation in art of U.S. Ser. No. 09/114,766 filed Jul. 14, 1998 now U.S. Pat. No. 6,015,100, naming Mario J. Restive as the inventor which claims priority to U.S. Ser. No. 60/052,585 filed Jul. 15, 1997.

FIELD OF THE INVENTION

The present invention relates to nozzles for aerating a relatively low pressure liquid stream to produce a sprayable foam, and more particularly, to a nozzle assembly which permits ready interchangeability of a nozzle tip for creating different foam spray application patterns.

BACKGROUND OF THE INVENTION

Foams are typically produced by the mixing of a chemical, water and a gas under certain conditions. The particular chemicals employed depends upon the desired use of the foam. For example, in the agricultural arena foams are often used to apply pesticides and are often preferable to liquid application.

The application of chemicals in a foamed condition offers a number of benefits. The foam application permits the chemicals to be used with lower supply rates and active chemical content, thereby reducing costs. Further, the use of a foam composition reduces health and safety hazards caused by the splashing or drift of tiny droplets or a fine mist. Because a foam is readily visible it also provides a convenient way for visually determining coverage.

Generally, two basic methods have been utilized to generate foams. One method is the use of a chemical foaming agent which is added to the solution, and the solution is then foamed. The other method is the introduction of gas such as air into the liquid to form minute bubbles, thereby collectively forming the foam. The application of agricultural chemicals by foam generating equipment traditionally includes a nozzle unit which mixes air with liquid chemicals.

The type and consistency of foam created by particular foam generating nozzles is a function of a number of factors, including the chemicals to be applied, the pressure of the material when applied to the nozzle unit and the design of the nozzle unit. A resulting consistency of the foam is often dictated by the anticipated application. That is, for applications requiring prolonged retention on a vertical or downward facing surface, it is usually desirable to apply the material as a thick foam. Such foams often follow a 1:10 ratio, that is for each unit volume of liquid, 10 unit volumes of foam are produced. Alternatively, if penetration of a porous surface is desired, the foam is preferably formed with a minimally sized bubbles in a ratio of approximately 1:2.

It has been found that at the relatively low operating pressures, it is difficult to obtain sufficiently small particle size and hence sprayable foam generation. Therefore, prior systems have relied upon relatively high fluid pressures for foam generation. The prior foam generating devices are relatively high pressure units requiring 40 psi or more. The mechanisms required to generate these relatively high pressures and the inability of the foaming nozzles to efficiently use the available energy at low pressures have prevented relatively low pressure foaming technology in a truly portable, human transportable foaming apparatus.

Further, in view of the relatively complicated structure required for the passage of a liquid, introduction of air, generation of foam and application of the foam, a given foaming nozzle unit traditionally creates only a single type foam. That is, if alternative chemical compositions, or application patterns are desired, the nozzle unit must be completely removed and an entirely new nozzle unit applied. This increases the cost of the foam applicators.

Therefore, a need exists for a foaming nozzle assembly which is easily reconfigured to create a variety of foams. Further, the need exists for a foam generating nozzle which may be readily disassembled, cleaned and reassembled. The need also exists for such a nozzle assembly which may be reconfigured with interchangeable components. A similar need exists for a foaming nozzle assembly that can employ interchangeable nozzle tips or be constructed at cost that allows interchangeability. A further need exists for a foam generating nozzle that can be used in relatively low pressure applications, such as less than approximately 35 psi and still generate sufficient quantities of foam.

SUMMARY OF THE INVENTION

The present invention provides a foaming nozzle assembly for generating a sprayable foam at relatively low fluid pressures, below approximately 35 psi. Preferably, the foaming nozzle produces foam at pressures as low as 25 psi. The present foaming nozzle assembly may be readily attached to a wand. The foaming nozzle may also be disconnected from the wand and disassembled to allow for the ready interchangeability of the components, including a nozzle tip. Thus, the present invention allows a modification of the foam characteristics and application pattern without requiring the use of an entirely new assembly. The sprayable foam formed by the present foaming nozzle assembly reduces wind drift, lowers the required chemical concentration and allows for visual confirmation of both the spray path and the treated areas.

Generally, the present foaming nozzle assembly includes an elongate housing with a first end configured to releasably engage a conduit or wand, and a second end defining an outlet aperture. The housing further includes a stop and a radially directed air inlet port. The foaming nozzle assembly further includes a nozzle tip having a shoulder for cooperatively engaging the stop. The nozzle tip is constructed to be slideably disposed within the housing from the first end so as to seat against the stop and substantially occlude the outlet aperture. The foaming nozzle assembly further includes a throat having a divergent end and a convergent end, the throat being sized to be slideably disposed within the housing and contact the divergent end with the nozzle tip. Finally, the foaming nozzle assembly includes a venturi nozzle/deflector sized to be disposed within the housing such that the deflector portion operably aligns with the air inlet port in the housing and the venturi nozzle/deflector contacts the convergent end of the throat.

In an alternative configuration, the foaming nozzle assembly is constructed of two pieces. The two piece design may be formed in at least two configurations. In a first configuration of the two piece design, the foaming nozzle assembly is constructed of a flow body and a nozzle tip. The flow body includes structure corresponding to the venturi nozzle/deflector, the throat and a portion of the housing of the first embodiment. The flow body is an integrally formed single piece construction that includes structure corresponding to the venturi nozzle/deflector, the throat and a portion of the housing of the first embodiment. The nozzle tip is mechanically engaged the flow body to control the desired spray pattern and assist with foam generation. As the nozzle tip can be releasably attached to the flow body, the nozzle tip can be readily interchanged without requiring extensive downtime.

In the second configuration of the two piece embodiment, the foaming nozzle assembly is formed of mating halves along the flow path or longitudinal axis of the assembly. That is, each mating half includes a portion of the housing, the venturi nozzle/deflector, the throat and the nozzle tip. In this construction, the nozzle tips are not interchangeable with the remainder of the foaming nozzle assembly, but rather the entire foaming nozzle assembly is readily interchangeable with respect to the wand.

The present invention also contemplates a method of assembling a foaming nozzle assembly including slideably disposing a nozzle tip within an elongate housing, such that motion of the nozzle tip through the housing is limited by contact between the nozzle tip and the housing; disposing a diverging throat within the housing to be operably disposed with respect to the nozzle tip; disposing a venturi nozzle/deflector within the housing to operably align with the throat, thereby providing fluid communication through the venturi nozzle/deflector, the throat and the nozzle tip, and providing fluid access from a radial port in the housing to a convergent end of the throat.

Alternatively, the present invention contemplates a method of assembling a foaming nozzle assembly by engaging a nozzle tip with a body having a venturi nozzle/deflector and a throat to define a flow path therethrough. A further method encompasses assembling a foaming nozzle assembly by mating a pair of assembly halves, each half including a portion of a venturi nozzle/deflector, a throat and a nozzle tip.

DETAILED DESCRIPTION OF THE PREFERRED EMBODIMENTS

Figure 1:
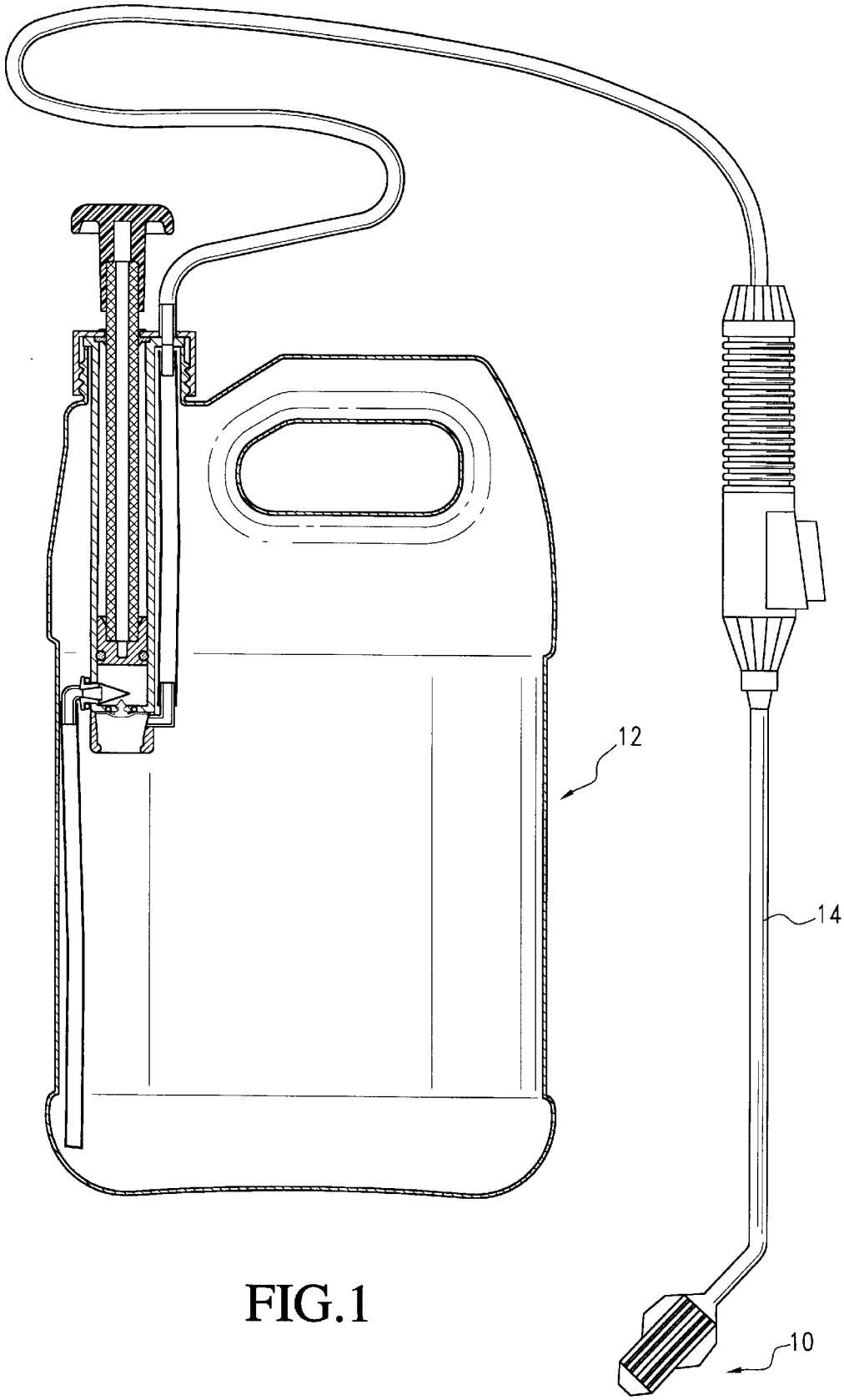
FIG. 1 is a side elevational partial cross sectional view of a foaming nozzle assembly operably connected to a liquid source.
Figure 2:
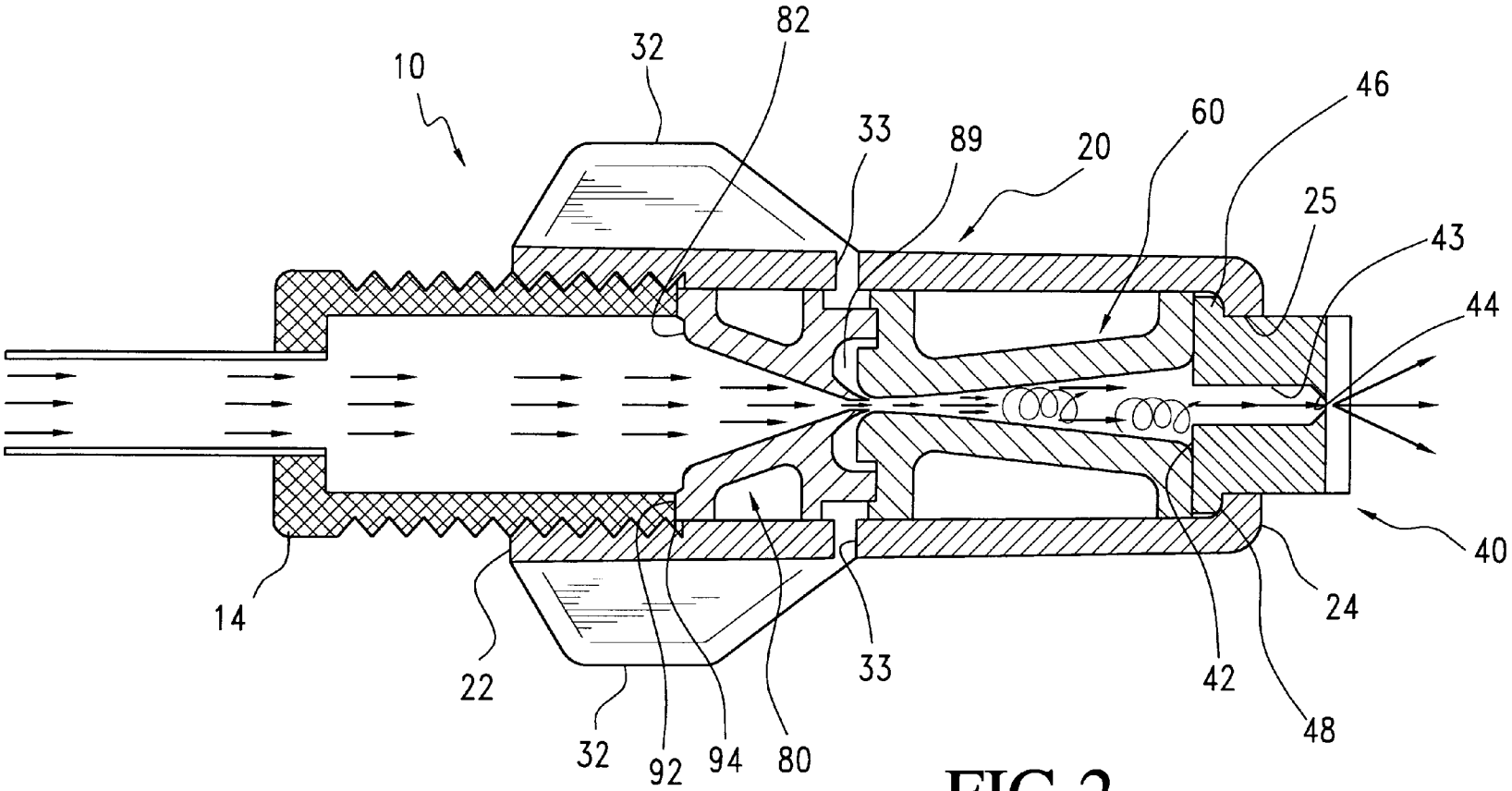
FIG. 2 is a cross sectional view of the foaming nozzle assembly.
Figure 4:
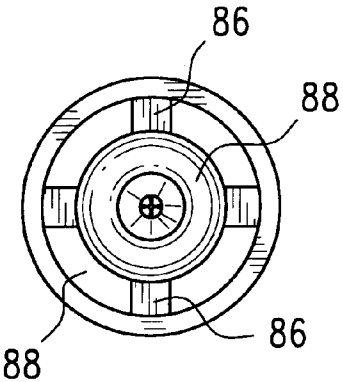
FIG. 4 is an end view from downstream of the venturi nozzle/deflector of FIG. 3.
Figure 3:
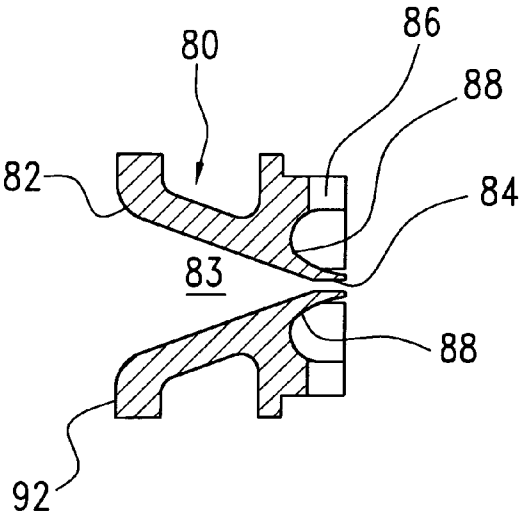
FIG. 3 is a cross sectional view of a venturi nozzle/deflector for the foaming nozzle assembly.
Figure 7:
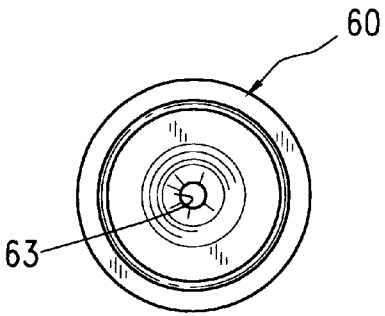
FIG. 7 is an end view from downstream of the throat of FIG. 5.
Figure 5:
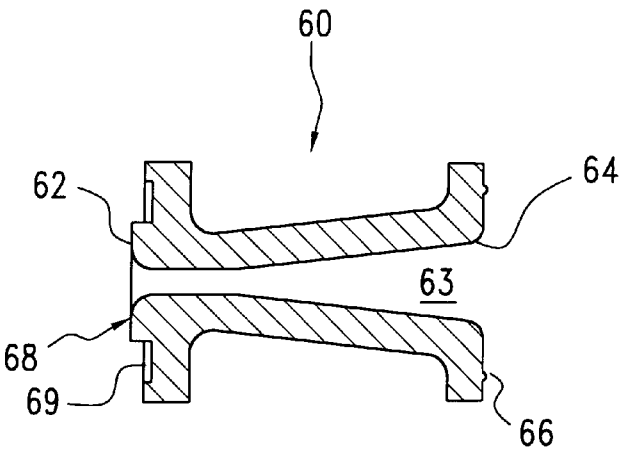
FIG. 5 is a cross sectional view of a throat for the foaming nozzle assembly.
Figure 6:
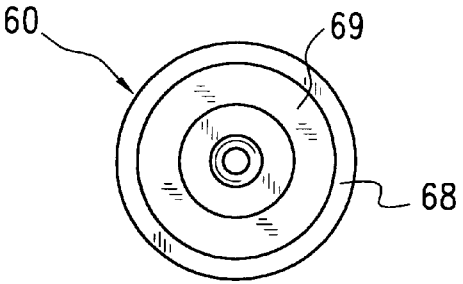
FIG. 6 is an end view from upstream of the throat of FIG. 5.
Figure 8:
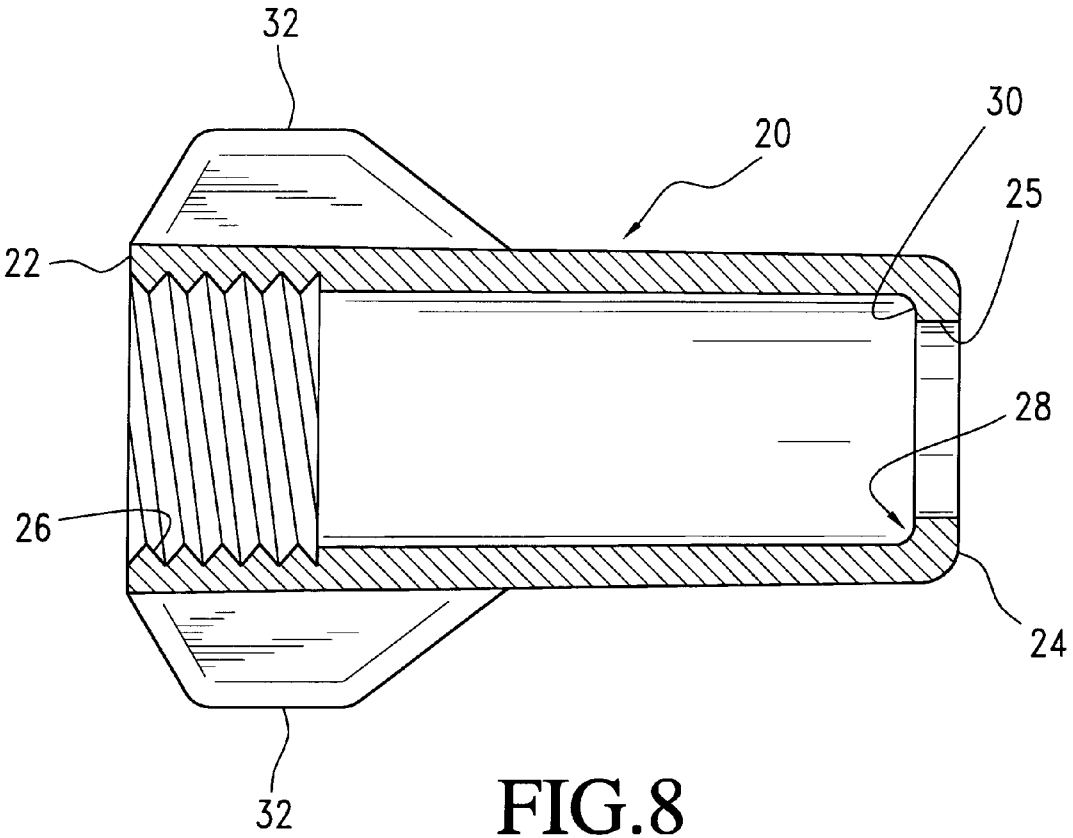
FIG. 8 is a cross sectional view of a housing for the foaming nozzle assembly.
Figure 9:
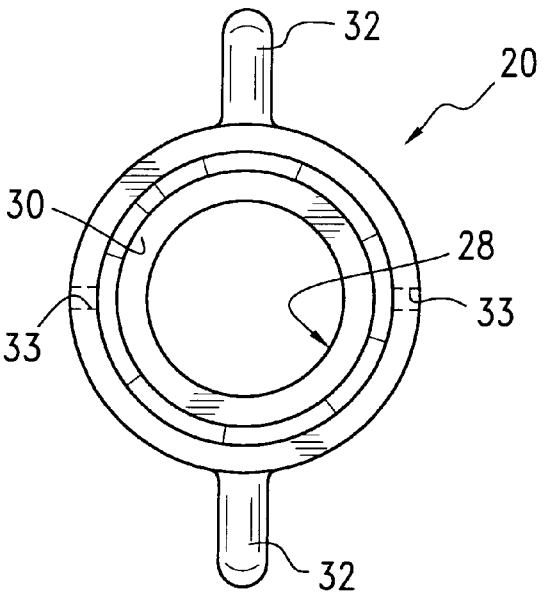
FIG. 9 is an end view of a housing for the foaming nozzle assembly.

Referring to FIG. 1, a foaming nozzle assembly 10 of the present invention is shown. The foaming nozzle assembly 10 operably connects to a source 12 of the liquid to be foamed. Typically, an interface between the foaming nozzle assembly 10 and the source 12 is a rigid self supporting wand 14. The wand 14 may include threads, snap fits or other mechanical connection configurations for operably connecting to the foaming nozzle assembly 10. However, it is understood that any of a variety of interfaces to the source 12 may be employed.

The foaming nozzle assembly 10 includes a housing 20, a nozzle tip 40, a throat 60 and a venturi deflector/nozzle 80.

The Housing

The housing 20 is a substantially tubular elongate member having an upstream wand engaging end 22 and a downstream nozzle end 24 disposed along a longitudinal axis. Preferably, the housing 20 is a cylindrical member having an interior and an exterior. A length of the interior adjacent the wand end 22 includes a plurality of threads 26. The nozzle end 24 includes a nozzle port 25, and a stop 28. The stop 28 is a collar projecting radially inward toward the longitudinal axis of the housing 20. The collar forms an annular seating surface 30. A plurality of ribs or fins 32 project from the housing 20 to form levers for assisting in the connection of the nozzle assembly 10 to the wand 14. The housing 20 includes at least one and preferably a plurality of air inlet ports 33 intermediate the wand end 22 and the nozzle end 24.

The housing 20 may be formed by any of a variety of materials that are inert to the compositions to be foamed, such as wear resistant polymers. A preferred material for construction of the housing is Delran as manufactured by E. I. DuPont.

The Nozzle Tip

The nozzle tip 40 is configured to be slideably received within the housing 20. The nozzle tip 40 is disposed in the nozzle end 24 of the housing 20 to provide an exit passage of the foaming composition from the foaming nozzle assembly 10. The nozzle tip 40 is sized to be slideably received within the wand end 22 of the housing 20 and slide to the nozzle end 24. The nozzle tip 40 has a through passage 43 from an upstream inlet 42 to a downstream foam spray outlet 44. The particular foam spray outlet 44 of the nozzle tip 40 is selected for producing the specific foam pattern and may be any of a variety of constructions. The foam spray outlet 44 defines an area through which the pressurized liquid area mixture exits the nozzle assembly 10. The nozzle tip 40 includes a shoulder 46 sized to contact the stop 28 and preclude further travel of the nozzle tip 40 with respect to the housing 20. Preferably, contact between the shoulder 46 and the seating surface 30 substantially precludes fluid flow therebetween under operating pressures. The upstream end 42 of the nozzle tip 40 forms an upstream seating surface 48 for contacting the throat 60.

The nozzle tip 40 may be formed of any of a variety of materials such as brass, wear resistant polymers or plastic. Alternatively, the nozzle tip may be one of a commercially available style.

The Throat

The throat 60 defines a central passage 63 and has a convergent upstream end 62 and a divergent downstream end 64. The throat 60 is also sized to be slideably received within the housing 20, passing through the wand end 22 to slide towards the nozzle end 24. The throat 60 includes peripheral flanges to locate, or center, the throat with respect to the housing 20. The downstream, divergent end 64 of the throat 60 includes a downstream seating surface 66 sized to cooperatively engage the upstream seating surface 48 of the nozzle tip 40. The convergent end 62 includes contact surfaces 68 for abutting the nozzle tip 40.

The upstream end 62 of the throat 60 includes at least one locating recess 69. The locating recess 69 is in the form of an annular recess in an upstream face of the throat 60.

In a preferred embodiment, the throat 60 has a total passage length approximately of 0.9 inches, and a convergent end diameter of approximately 0.078 inches. The convergent end diameter extends along the longitudinal axis for a length of approximately 0.3 inches, then flares at an angle of approximately 6 (12 conical angle) to a divergent end diameter of 0.3 inches. It has been found the same configuration of the throat 60 may be employed for a 0.1 and a 0.2 gallon per minute flow rate through the nozzle assembly 10.

The throat 60 may be formed of a plastic wear resistant polymer.

The Venturi Deflector/Nozzle

The venturi deflector/nozzle 80 is sized to be slideably received within the housing 20, passing from the wand end 22 toward the nozzle end 24. The venturi deflector/nozzle 80 defines a converging, funnel shaped central passage 83 extending along the longitudinal axis from an upstream open end 82 to a downstream restricted venturi end 84. The venturi deflector/nozzle 80 is sized to operably align the convergent end of the central passage 83 with the convergent end 62 of the throat 60. The venturi deflector/nozzle 80 may also include a pair of peripheral flanges to locate, or center the nozzle with respect to the housing 20. The downstream end 84 of the venturi deflector/nozzle 80 includes a plurality of locator bosses 86. The locator bosses 86 are located at an equal radius from the longitudinal axis and are sized to be received or registered within the locating recesses 69 of the throat 60. The locator bosses 86 of the venturi deflector/nozzle 80 and locating recesses 69 of the throat 60 thereby form a space between the venturi deflector/nozzle and the throat.

The locator bosses 86 and locating recesses 69 are sized to dispose a length of the venturi end 84 within the convergent end 62 of the throat 60. That is, a portion of the venturi deflector/nozzle 80 and the throat 60 overlap along the longitudinal axis, with the throat having the larger diameter and the restricted end of the venturi deflector/nozzle having the smaller diameter. An outer surface of the restricted end 84 of the venturi deflector/nozzle 80 and the convergent end 62 of the throat 60 define an introduction annulus 89 therebetween. The introduction annulus 89 is fluidly connected to the radial ports 33 in the housing 20.

Preferably, the outer surface 88 of the venturi end 84 of the venturi deflector/nozzle 80 forms deflector surfaces which redirect a radially inward air flow substantially parallel to the longitudinal axis.

The upstream, open end 82 of the venturi deflector/nozzle 80 includes a seating surface 92 for contacting the wand or an assembly seal.

The venturi deflector/nozzle 80 thus defines a primary flow control surface defined by the central passage 83 for directing liquid from the source 12 to the throat 60. The venturi deflector/nozzle 80 also defines a secondary flow control surface defined by the outer surface 88 for introducing air from the radial port to the liquid flow passing from the primary flow control surface substantially parallel to the longitudinal axis.

The venturi deflector/nozzle 80 may be configured to provide a variety of flow rates. For example, in a 0.2 gallon per minute configuration, the venturi deflector/nozzle 80 defines a central passage 83 having a length of 0.54 inches, with an open end 82 diameter of approximately 0.36 inches and a restricted end 84 inner diameter of 0.04 inches. The outer surface 88 of the restricted end 84, which defines a portion of the introduction annulus 89 has a diameter of 0.059 inches. The venturi deflector/nozzle 80 converges from the open end 82 to the restricted end 84 at an angle of approximately 20° from the longitudinal axis (conical angle of approximately 40°). In a 0.1 gallon per minute configuration, the restricted end 84 of the venturi deflector/nozzle defines an inner diameter of approximately 0.32 inches.

At least one of the seating surface 30 of the stop 28 and the shoulder 46 of the nozzle tip 40, and the upstream seating surface 48 of the nozzle tip 40 and the downstream divergent end 64 of the throat 60 include a raised bead which may be made in the formation process. The raised bead increases the effective seating pressure between the relative components, thereby increasing the sealing and reducing fluid flow therebetween.

The ratio of the area of the venturi end 84 and the area of the nozzle tip foam spray outlet 44 defines a balance between the need to have a sufficient flow velocity exposed to the radial air inlet ports 33 and a sufficient back pressure to induce turbulent mixing in the throat 60. The venturi end 84 and the foam spray outlet 44 act as a pair of resistors in series which are balanced to draw in sufficient air and generate foam from the air-liquid mixture. If the foam spray outlet 44 is sized too small, then the back pressure is too great and insufficient air is drawn through the ports 33 into the nozzle assembly 10. Conversely, if the foam spray outlet 44 is too large, then the air-liquid mixture does not mix in the throat 60 and no foam in generated.

Similarly, a sufficient flow rate through the venturi nozzle/deflector 80 is required to generate a usable quantity of foam. Further, the present design must accommodate the relatively low flow rate of less than 0.5 gallons per minute and often between 0.1. and 0.2 gallons per minute. Such a small flow rate requires a small orifice sizing at the foam outlet 44. However, small orifices create significant pressure drops across the orifice. The present design is selected to retain a sufficient pressure differential across the foam spray outlet 44 to permit ejection of a foam spray on the order of 5 to 10 feet from an initial liquid pressure of approximately 20 to 25 psi. The venturi nozzle/deflector 80 may also be formed of a wear resistant plastic polymer.

The present nozzle assembly 10 is selected to provide a liquid to generated foam volume of approximately 1:2.

Assembly

To assemble the foaming nozzle assembly 10, a nozzle tip 40 is disposed within the housing 20 such that the nozzle shoulder 46 contacts the collar of the stop 28 and passage of the nozzle tip through the nozzle port 25 in the housing is precluded. The throat 60 is then slideably disposed within the housing 20 such that the downstream, divergent end 64 of the throat 60 contacts the upstream end 42 of the nozzle tip 40.

The venturi deflector/nozzle 80 is then slideably disposed within the housing 20 to dispose the locator bosses 86 within the locator recesses 69 on the upstream end 62 of the throat 60.

An O-ring seal 94 is then disposed in the wand end of the housing. The O-ring is sized to retain the nozzle tip 40, the throat 60 and the venturi deflector/nozzle 80 within the housing 20. Thus, the components are operably aligned within the housing 20 and unintended separation of the component from the housing is substantially precluded.

The wand 14 is then threadingly engaged with the housing 20 until the end of the wand contacts the O-ring 94. Contact of the wand 14 and the O-ring 94 slightly compress the components thereby forming a sealed relation, as well as retaining them in their operable position. The present invention is directed to low pressure foaming devices and particularly those devices operating below approximately 35 psi. In particular, the present invention is directed to such low pressure systems operating at 25 psi or less.

Two Piece Foaming Assembly

Figure 10:
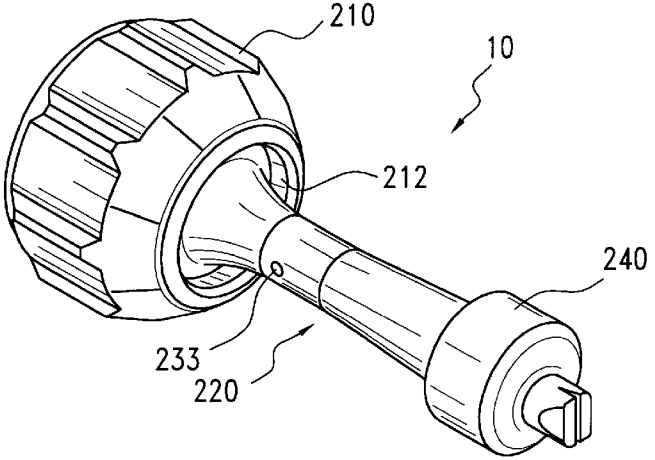
FIG. 10 is a perspective view of a two piece foaming nozzle assembly.
Figure 11:
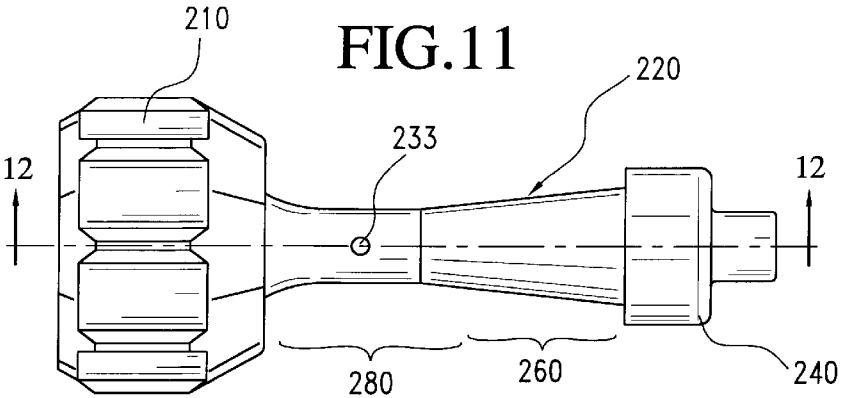
FIG. 11 is a side elevational view of the foaming nozzle assembly of FIG. 10.
Figure 12:
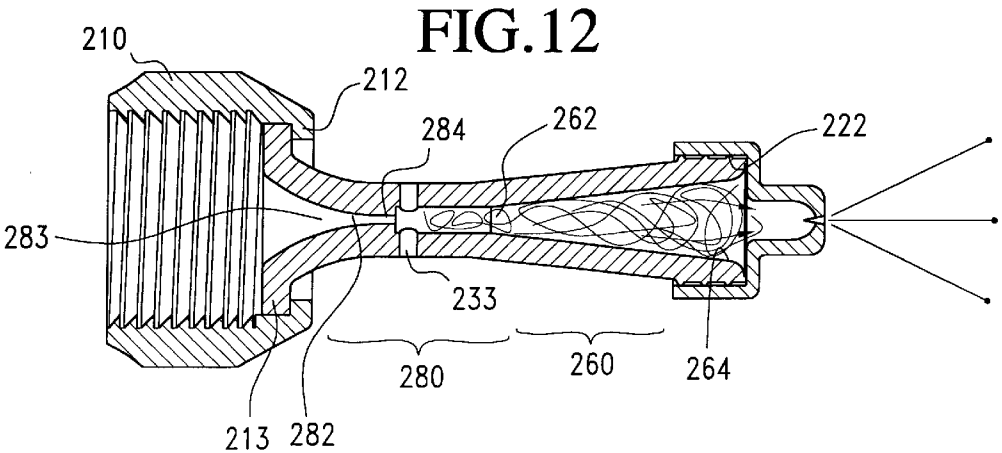
FIG. 12 is a cross sectional view of the two piece foaming nozzle assembly of FIG. 11 taken along lines 12—12.
Figure 13:
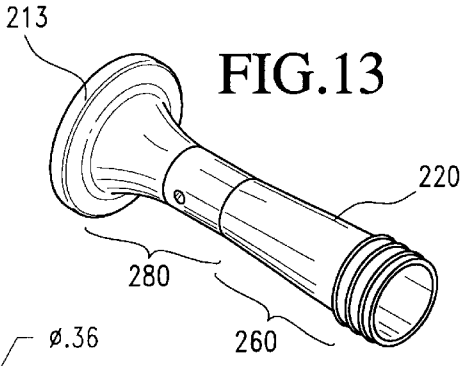
FIG. 13 is a perspective view of the flow body of the two piece foaming nozzle assembly of FIG. 10.
Figure 16:
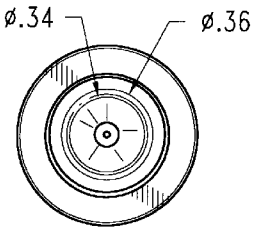
FIG. 16 is an end view of the downstream end of the flow body of FIG. 14.
Figure 19:
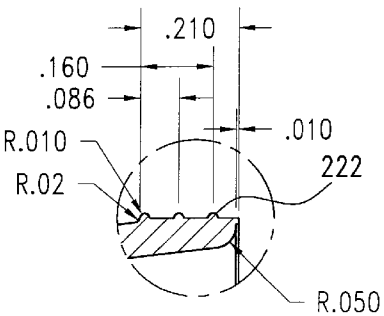
FIG. 19 is an enlarged detail view of the area 19 of FIG. 17.

Referring to FIGS. 10–12, the foaming nozzle assembly 10 can be formed of two pieces, a flow body 220 and a nozzle tip 240. The flow body 220 is connected to the source 12 of the liquid to be foamed. Typically, an interface between the foaming nozzle assembly 10 and the source 12 is a rigid self supporting wand 14. The wand 14 may include threads, snap fits or other mechanical connection configurations for operably connecting to the foaming nozzle assembly 10. However, it is understood that any of a variety of interfaces to the source 12 may be employed. As shown in FIGS. 10–12, a threaded retainer 210 having a capture flange 212 is used to operably locate the foaming nozzle assembly with respect to the wand 14.

The flow body 220 includes a venturi portion 280, a throat portion 260 and at least one air inlet port 233. The flow body 220 includes a retaining flange 213 sized to contact the retainer 210 and specifically the capture flange 212 to be located intermediate the threads of the wand and the capture flange 212 of the retainer. Preferably, the flow body is a one piece integral construction, formed by molding, such as injection molding. However, the flow body may be machined or tooled.

The venturi portion 280 defines a converging, funnel shaped central passage 283 extending along the longitudinal axis from an upstream open end 282 to a downstream restricted venturi end 284.

The venturi deflector/nozzle 280 thus defines a primary flow control surface defined by the central passage 283 for directing liquid from the source 12 to the throat portion 260.

The venturi deflector/nozzle 280 may be configured to provide a variety of flow rates. For example, in a 0.2 gallon per minute configuration, the venturi deflector/nozzle 280 defines a central passage 283 having a length of 0.54 inches, with an open end 282 diameter of approximately 0.36 inches and a restricted section 284 inner diameter of 0.04 inches. The venturi deflector/nozzle 280 converges from the open end 282 to the restricted section 284 at an angle of approximately 20° from the longitudinal axis (conical angle of approximately 40°). In a 0.1 gallon per minute configuration, the restricted section 284 of the venturi deflector/nozzle defines an inner diameter of approximately 0.32 inches.

The throat portion 260 defines a length of the central passage 283 and has a convergent upstream end 262 and a divergent downstream end 264.

In a preferred embodiment, the throat portion 260 has a total passage length of approximately 0.9 inches, and a convergent end diameter of approximately 0.078 inches. The convergent end diameter extends along the longitudinal axis for a length of approximately 0.3 inches, then flares at an angle of approximately 6° (12° conical angle) to a divergent end diameter of 0.3 inches. It has been found the same configuration of the throat portion 260 may be employed for a 0.1 and a 0.2 gallon per minute flow rate through the nozzle assembly 10.

Figure 18:
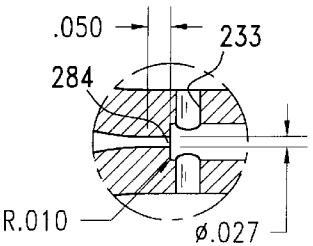
FIG. 18 is an enlarged detail view of the area 18 of FIG. 17.
Figure 14:
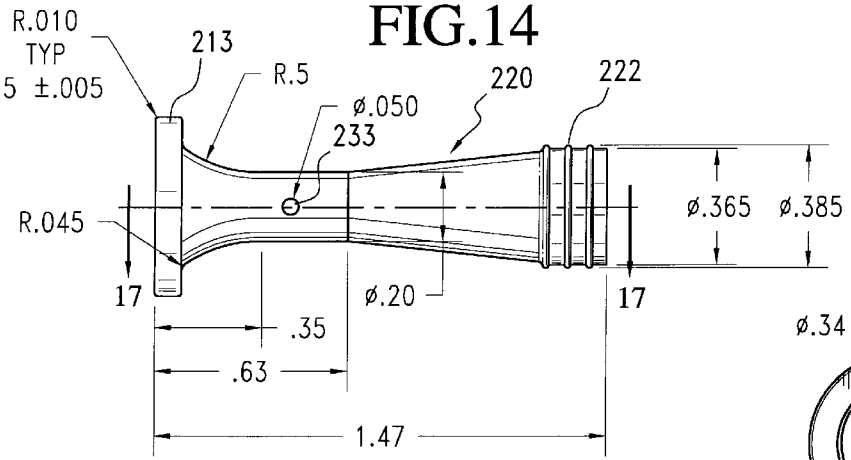
FIG. 14 is a side elevational view of the flow body of FIG. 13.
Figure 15:
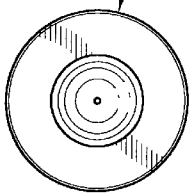
FIG. 15 is an end view of the upstream end of the flow body of FIG. 14.
Figure 17:
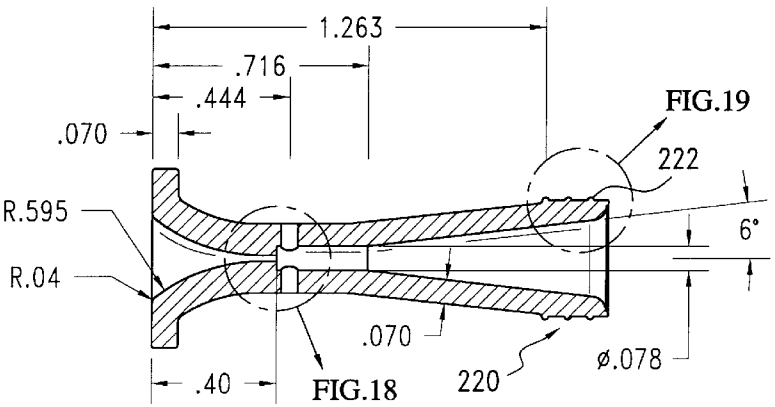
FIG. 17 is a cross sectional view of the flow body taken along lines 17—17 of FIG. 14.
Figure 20:
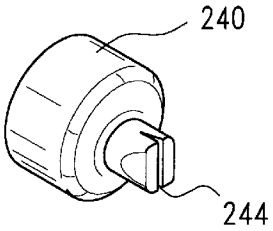
FIG. 20 is a perspective view of a nozzle tip for the foaming nozzle assembly of FIGS. 10–12.
Figure 21:
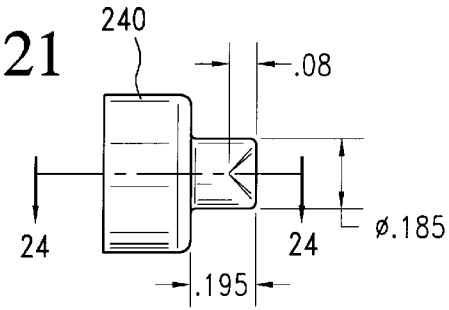
FIG. 21 is a side elevational view of the nozzle tip of FIG. 20.
Figure 23:
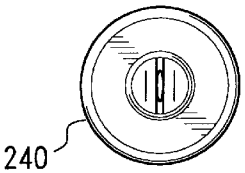
FIG. 23 is an end view of the downstream end of the nozzle tip of FIG. 20.
Figure 25:
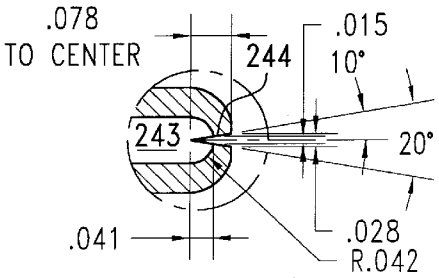
FIG. 25 is an enlarged detail view of the area 25 of FIG. 24.
Figure 24:
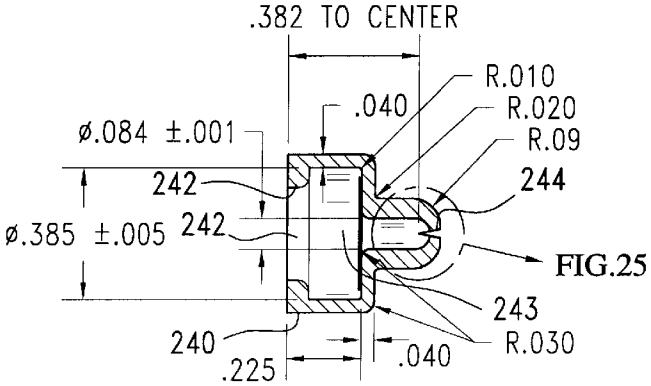
FIG. 24 is a cross sectional view taken along lines 24—24 of FIG. 21.
Figure 22:
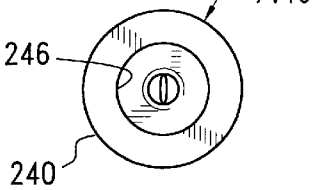
FIG. 22 is an end view of the upstream end of the nozzle tip of FIG. 20.

As shown in FIGS. 17 and 18, the air inlet ports 233 intersect the central flow passage just downstream of the smallest diameter of the flow passage. A shoulder may be formed in the central passage 283 adjacent the intersection of the air inlet ports 233 to assist in foam generation.

Referring to FIGS. 12, 13, 14, 17 and 19, an outer surface of the downstream end of the flow body 220 includes a structure for frictionally engaging and retaining the nozzle tip 240. The structure may be flanges, tabs, fingers detents or ribs as shown. This structure is sufficient to retain the nozzle tip 240 relative to the flow body 220. Although a secondary seal such as a gasket may be disposed intermediate the nozzle tip and the flow body, it has been found that a plurality of ribs 222 may be formed on the flow body 220. The ribs 222 circumscribe the flow body and are sized to engage a corresponding portion of the nozzle tip. By employing a plurality of ribs 222, the nozzle tip can be sealed relative to the flow body 220 for intended operating parameters.

As shown in FIGS. 20–25, the nozzle tip 240 for operably engaging the flow body 220 is shown. The nozzle tip 240 provides an exit passage of the foaming composition from the foaming nozzle assembly 10. The nozzle tip 240 has a through passage 243 from an upstream inlet 242 to a downstream foam spray outlet 244. The particular foam spray outlet 244 of the nozzle tip 240 is selected for producing the specific foam pattern and may be any of a variety of constructions. The foam spray outlet 244 defines an area through which the pressurized liquid area mixture exits the nozzle assembly 10.

The nozzle tip 240 includes an inwardly projecting shoulder 246 sized to contact the ribs 222 on the flow body 220. The shoulder 246 and the ribs 222 are selected to cooperatively and releasably engage the nozzle tip 240 and the flow body 220. It is understood that a variety of configurations for the ribs and the shoulder may be employed such as recesses, channels or sockets. Preferably, contact between the shoulder 246 and the ribs 222 substantially precludes fluid flow therebetween under operating pressures.

Alternatively, and partially depending upon cost considerations, the flow body 220 and the nozzle tip 240 may include complimentary threads for threaded engagement.

The nozzle tip 240 may be formed of any of a variety of materials such as brass, wear resistant polymers or plastic. Alternatively, the nozzle tip may be one of a commercially available style.

Referring to FIGS. 26–36, an alternative configuration of the two piece foaming nozzle assembly is shown. In this configuration, the two pieces are mating pieces 310 separated along the flow path through the foaming nozzle assembly. Each mating half 310 includes a portion of the venturi, the throat and the nozzle tip.

Figures 26, 27, 28, 29, 30, 31, 32, 33, 34:
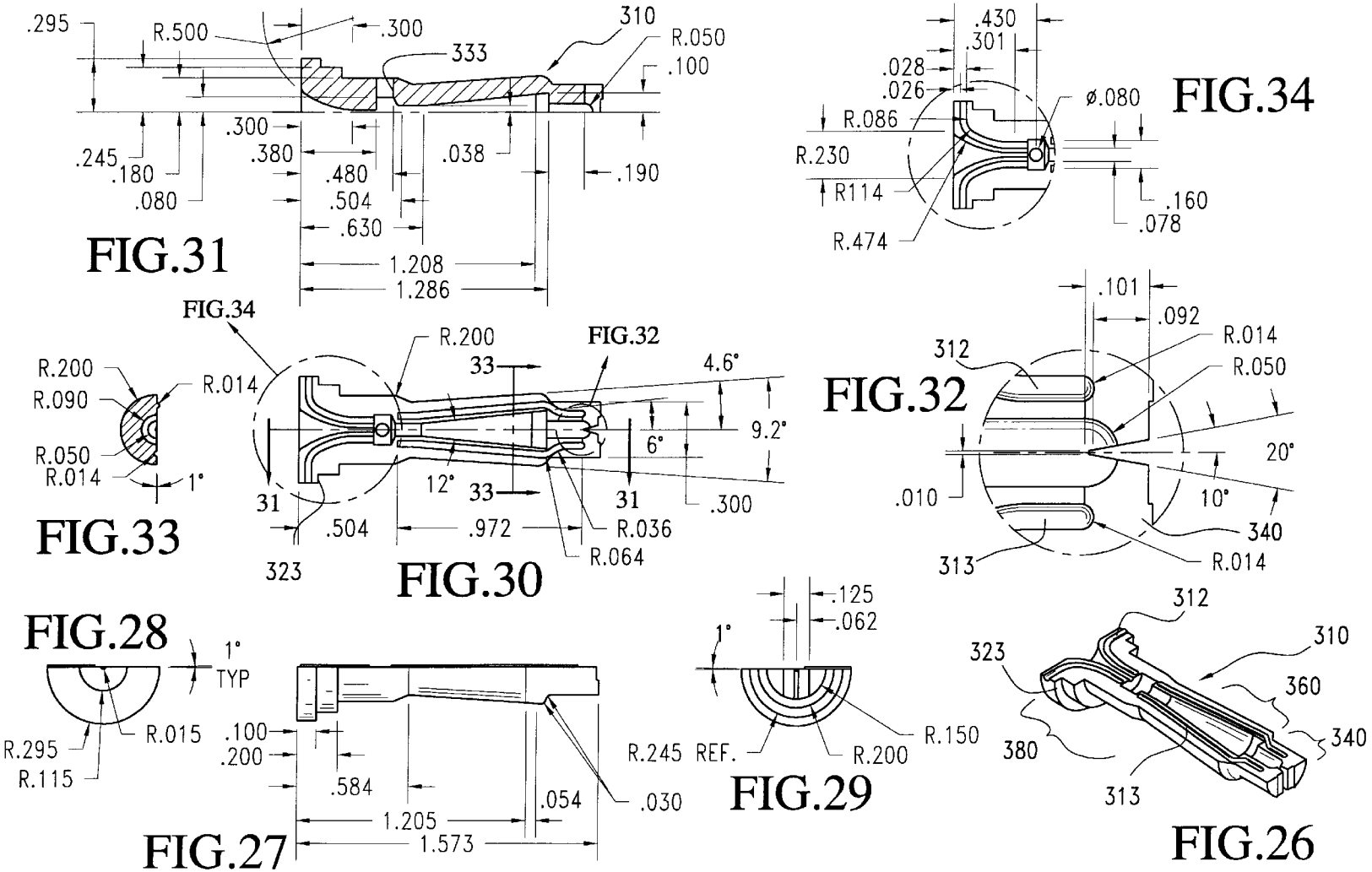
FIG. 26 is a perspective view of a component of an axially separated two piece construction of the foaming nozzle assembly.
FIG. 27 is a side elevational view of the component of FIG. 26.
FIG. 28 is an end view of the upstream end of the component of FIG. 27.
FIG. 29 is an end view of the downstream end of the component of FIG. 27.
FIG. 30 is a top plan view of the component of FIG. 26.
FIG. 31 is a cross sectional view taken along lines 31—31 of FIG. 30.
FIG. 32 is an enlarged detail view of the area 32 of FIG. 30.
FIG. 33 is a cross sectional view taken along lines 33—33 of FIG. 30.
FIG. 34 is an enlarged detail view of the area 34 of FIG. 30.

Although the mating halves 310 may be formed as male and female, it is intended for ease of manufacturing that only a single half be formed such that two of the halves 310 may be cooperatively engaged to form the foaming nozzle assembly 10. Specifically, as shown in FIGS. 26 and 30, the mating half 310 includes a projecting rib 312 and a channel recess 313 sized to receive the rib on mirror positions about the longitudinal axis of the assembly.

Thus, each mating half includes an air inlet port 333, a venturi portion 380 a throat portion 360 and a nozzle portion 340. Each mating half 310 also includes a portion of a retaining flange 323 for operably connecting the assembly to the wand 14. The mating halves 310 may be operable joined by adhesives, thermal bonding or ultrasonic welding.

It is intended that the performance parameters of the mating halves 310 match the remaining embodiments of the foaming nozzle assembly 10, and hence the dimensions are applicable to the mating halves configuration.

Operation

In operation, the relatively low pressure is applied to the liquid source 12, thereby urging liquid from the source toward the nozzle tip 40 which is at ambient or atmospheric pressure. As the fluid flow is converged in the venturi deflector/nozzle 80, the velocity increases as it passes through the restricted end 84 and into the convergent end 62 of the throat 60. The increased velocity, pursuant to Bernoulli's equation, reduces the local pressure thereby drawing air in from the radial ports 33 through the housing 20, between the venturi deflector/nozzle 80 and the upstream end 62 of the throat 60 through the introduction annulus 89 and into the convergent end of the throat. The fluid stream and the introduced air then mix as the flow becomes turbulent and passes toward the divergent end 64 of the throat 60. The produced foam is then urged into the nozzle tip 40 where it is ejected through the orifice port 44 the pattern determined by the geometry and construction of the nozzle tip.

In the flow body 220-nozzle tip 240 configuration, the retainer 210 is threaded onto the wand to dispose the retaining flange 213 intermediate the capture flange 212 and the wand or an O ring gasket.

The nozzle tip 240 may be selected and snapped or threaded onto the flow body 220. As liquid passes through the flow body 220, air is drawn into the flow via the air inlet ports 233 and the turbulent characteristic of the flow induces mixing and foam generation as the mixture exits through the attached nozzle tip.

In the mating halves configuration, the halves are joined prior to use so that an operator merely engages the mated halves with the wand and operates as in the remaining embodiments.

The present invention and its advantages will be understood from the foregoing description, and it will be apparent that various changes may be made thereto without departing from the true spirit and scope of the invention or sacrificing all of its material advantages, the form herein before described being merely preferred or exemplary embodiments thereof.

What is claimed is:

1. A spray foaming nozzle assembly for releasably engaging a conduit, comprising:

(a) a one piece housing including a central passage for conducting a fluid flow through the housing, the central passage defining a venturi including a converging section, a downstream diverging section terminating at an outlet end and a restricted section intermediate the converging section and the diverging section, the housing including an air inlet port extending radially through a wall of the housing and intersecting the restricted section for fluidly connecting to the central passage; and (b) a nozzle tip engaging the housing at the outlet end of the diverging section, the nozzle tip having a central passage there through that has a cross sectional area less than the diverging section and the nozzle tip having a wall butting against the outlet end and extending radially inward to partly occlude the size of the diverging section outlet down to the size of the nozzle tip central passage.

2. The foaming nozzle spray assembly of claim 1, wherein the portion of the central pass;age defined by the nozzle tip is shorter in length than the length of the portion of the central passage defined by the diverging section.

3. The foaming nozzle spray assembly of claim 1, wherein the portion of the central passage defined by the converging section and the restricted section together is approximately the same as the length of the portion of the central passage defined by the diverging section.

4. A foam generating nozzle for releasably engaging a conduit, comprising:

(a) a pair of mating housing halves that are arranged to join together along a longitudinal flow path, each half defining a longitudinal half of a central passage including a venturi portion with a throat portion, an air inlet portion extending through a wall of a mating half that intersects and connects to the throat portion and a nozzle tip portion at the end of the outlet portion; and (b) the mating halves selected to engage to form a housing including i) a central passage defining a venturi having a converging inlet section, throat portion and a diverging outlet section with an air inlet passage passing through a wall of the housing and intersecting the central passage at the throat portion and ii) an integral nozzle tip defining the terminal end portion of the central passage that has a smaller cross section than the diverging outlet section.

5. The foam generating nozzle of claim 4, wherein the mating halves are identical.

6. A spray foaming nozzle assembly for releaseably engaging a conduit, comprising:

(a) a housing defining a central flow passage including a venturi having a converging inlet section, a downstream outlet diverging section and a restricted section defining the smallest diameter of the central flow passage intermediate the converging section and the diverging, section, the housing including an air inlet port fluidly connected to the central flow passage just down stream of the smallest diameter of the flow passage; and (b) a nozzle tip engaging the outlet diverging section of the housing, the nozzle tip defining the terminal end portion of the central flow passage and a foam spray outlet, the terminal end portion of the central flow passage having a cross sectional area throughout its length that is less than the outlet of the diverging section.

7. A spray foaming nozzle assembly for releasably engaging a conduit, comprising:

(a) a housing including a central passage for conducting a fluid flow through the housing, the central passage defining a venturi including a converging section, a downstream diverging outlet section and a restricted section intermediate the converging and diverging sections, the housing including an air inlet port extending radially through a wall of the housing and intersecting the restricted section for fluidly connecting to the central passage;

(b) a nozzle tip engaging the housing at an outlet end of the diverging section, the nozzle tip in its engaging position having a wall butting against the outlet end and extending radially inward to partly occluding the outlet end;

(c) the nozzle tip including a flow path terminating in a foam outlet, the flow path and foam outlet together defining the terminal end portion of the central passage, the flow path having i) a cross sectional area throughout its length that is less than the cross sectional area of the outlet end of the diverging section; and ii) a length that is shorter than a length of the central passage defined by the diverging section;

(d) the length of the central passage defined by the converging section and the restricted section being approximately the same as a length of the central passage defined by the diverging section; and (e) the radial wall of the nozzle tip occluding the cross sectional area of the outlet end down to the same cross sectional area of the terminal end portion of the central passage as defined by the nozzle tip.

* * * * *